US008319596B2

(12) United States Patent
Pinto, IV et al.

(10) Patent No.: US 8,319,596 B2
(45) Date of Patent: Nov. 27, 2012

(54) ACTIVE MATERIAL CIRCUIT PROTECTOR

(75) Inventors: Nicholas W. Pinto, IV, Ferndale, MI (US); Paul W. Alexander, Ypsilanti, MI (US); Nancy L. Johnson, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 231 days.

(21) Appl. No.: 12/727,460

(22) Filed: Mar. 19, 2010

(65) Prior Publication Data

US 2010/0295654 A1 Nov. 25, 2010

Related U.S. Application Data

(63) Continuation-in-part of application No. 12/469,556, filed on May 20, 2009.

(51) Int. Cl.
*H01H 37/46* (2006.01)
*H01H 37/02* (2006.01)

(52) U.S. Cl. ..... 337/139; 337/123; 337/140; 337/382; 337/393; 337/394; 337/395

(58) Field of Classification Search ..... None
See application file for complete search history.

(56) References Cited

U.S. PATENT DOCUMENTS

| | | | | | |
|---|---|---|---|---|---|
| 3,256,990 | A | * | 6/1966 | Lundeen | 210/138 |
| 3,594,674 | A | * | 7/1971 | Willson | 337/139 |
| 3,634,803 | A | * | 1/1972 | Willson et al. | 337/123 |
| 3,638,083 | A | * | 1/1972 | Dornfeld et al. | 361/321.1 |
| 3,725,835 | A | * | 4/1973 | Hopkins et al. | 337/140 |
| 3,748,197 | A | * | 7/1973 | Willson et al. | 148/563 |
| 3,774,136 | A | * | 11/1973 | Zelenka | 337/382 |
| 3,967,227 | A | * | 6/1976 | Clarke et al. | 337/124 |
| 3,968,380 | A | * | 7/1976 | Jost et al. | 307/99 |
| 4,007,404 | A | * | 2/1977 | Jost et al. | 361/211 |
| 4,356,478 | A | * | 10/1982 | Muggli et al. | 340/593 |
| 4,423,401 | A | * | 12/1983 | Mueller | 337/107 |
| 4,517,543 | A | * | 5/1985 | Brubaker | 337/140 |
| 4,544,988 | A | * | 10/1985 | Hochstein | 361/211 |
| 4,551,975 | A | * | 11/1985 | Yamamoto et al. | 60/528 |
| 4,635,091 | A | * | 1/1987 | Roger | 257/771 |
| 4,700,541 | A | * | 10/1987 | Gabriel et al. | 60/528 |
| 4,887,430 | A | * | 12/1989 | Kroll et al. | 60/527 |
| 5,061,914 | A | * | 10/1991 | Busch et al. | 337/140 |
| 5,315,474 | A | * | 5/1994 | Kuriyama | 361/534 |
| 5,410,290 | A | * | 4/1995 | Cho | 337/140 |
| 5,612,662 | A | * | 3/1997 | Drekmeier et al. | 337/389 |
| 5,619,177 | A | * | 4/1997 | Johnson et al. | 337/140 |
| 5,770,993 | A | * | 6/1998 | Miyazawa et al. | 337/160 |
| 5,825,275 | A | * | 10/1998 | Wuttig et al. | 337/139 |
| 5,896,080 | A | * | 4/1999 | Chen | 337/407 |
| 5,920,251 | A | * | 7/1999 | Shea | 337/140 |
| 5,990,777 | A | * | 11/1999 | Whiteman, Jr. | 337/140 |
| 6,016,096 | A | * | 1/2000 | Barnes et al. | 337/123 |

(Continued)

FOREIGN PATENT DOCUMENTS

JP 2005-259488 A 9/2005

(Continued)

*Primary Examiner* — Anatoly Vortman
(74) *Attorney, Agent, or Firm* — Quinn Law Group, PLLC

(57) ABSTRACT

A circuit protector includes first and second conductive members. An active material alters at least one attribute in response to an activation signal. The active material is operatively connected to the first and second conductive members to alter the electrical resistance between the first and second members.

8 Claims, 2 Drawing Sheets

U.S. PATENT DOCUMENTS

| | | | | |
|---|---|---|---|---|
| 6,049,267 | A * | 4/2000 | Barnes et al. | 337/123 |
| 6,236,300 | B1 * | 5/2001 | Minners | 337/139 |
| 6,239,686 | B1 * | 5/2001 | Eder et al. | 337/382 |
| 6,504,467 | B1 * | 1/2003 | Berberich et al. | 337/139 |
| 7,372,355 | B2 * | 5/2008 | Agronin et al. | 337/126 |
| 7,504,925 | B2 * | 3/2009 | Graf et al. | 337/159 |
| 7,508,295 | B2 * | 3/2009 | Graf et al. | 337/159 |
| 7,554,432 | B2 * | 6/2009 | Graf et al. | 337/296 |
| 7,864,024 | B2 * | 1/2011 | Schlenker et al. | 337/407 |
| 7,928,826 | B1 * | 4/2011 | Woychik et al. | 337/140 |
| 2003/0058069 | A1 | 3/2003 | Schwartz et al. | |
| 2005/0161312 | A1 * | 7/2005 | Agronin et al. | 200/330 |
| 2006/0273876 | A1 * | 12/2006 | Pachla et al. | 337/140 |

FOREIGN PATENT DOCUMENTS

| | | | |
|---|---|---|---|
| KR | 10-2002-0018655 | A | 3/2002 |
| KR | 10-2006-0002988 | A | 1/2006 |

* cited by examiner

ACTIVE MATERIAL CIRCUIT PROTECTOR

CROSS REFERENCE TO RELATED APPLICATIONS

This application is a continuation-in-part of U.S. application Ser. No. 12/469,556, filed May 20, 2009, and which is hereby incorporated by reference in its entirety.

TECHNICAL FIELD

This invention relates to circuit protectors for protecting electronic components from excessive current.

BACKGROUND OF THE INVENTION

Electrical circuits are sometimes prone to overheating as a result of excessive current. As a result, circuits or components thereof may include circuit protectors that open the circuit in the event of excessive current flow, thereby preventing damage to the circuit components. Circuit protectors include fuses and mechanical circuit breakers.

Fuses include a conductive element that is configured to disintegrate or burn when the current flowing therethrough exceeds a predetermined amount, thereby opening the circuit. Mechanical circuit breakers include switches that automatically move to an open position when current flowing therethrough exceeds a predetermined amount. In an exemplary mechanical circuit breaker, the current flows through an electromagnet; when the current exceeds a predetermined amount, the magnetic field generated by the electromagnet is sufficient to move the switch to the open position.

SUMMARY OF THE INVENTION

A circuit protector includes a first electrically conductive member and a second electrically conductive member. The second electrically conductive member is selectively movable between a first position in which the second electrically conductive member contacts the first electrically conductive member, and a second position in which the second electrically conductive member does not contact the first electrically conductive member. The circuit protector further includes an active material that is configured to undergo a change in at least one attribute in response to an activation signal. The active material is operatively connected to the second electrically conductive member such that the change in at least one attribute causes the second electrically conductive member to move between the first and second positions, thereby selectively preventing the flow of electricity between the first and second members.

The circuit protector provided is resettable, unlike fuses. Furthermore, the circuit protector provided has less mechanical complexity than prior art circuit breakers, which enables the use of the circuit protector in applications in which the size or cost of prior art circuit breakers would be prohibitive.

An apparatus includes an electronic device, an electrical contact, and a circuit protector that at least partially define a conductive path between the contact and the electronic device. The circuit protector includes an active material that is configured to undergo a change in at least one attribute in response to an activation signal. The circuit protector is configured such that the change in at least one attribute alters the resistance of the conductive path between the contact and the electronic device.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
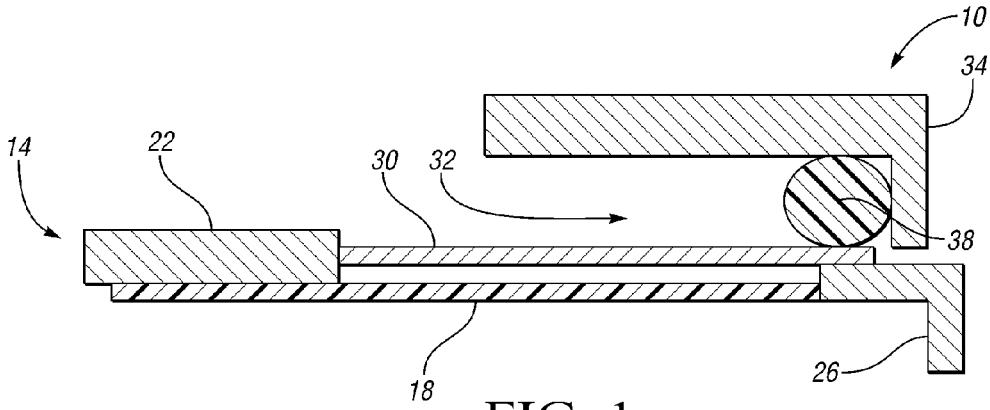
FIG. 1 is a schematic, sectional, side view of an electronic device and a circuit protector having a conductor in a first position.

Referring to FIG. 1, a portion of an electrical circuit 10 is schematically depicted. The circuit 10 includes at least one electronic device 14. In the embodiment depicted, the electronic device 14 is a microprocessor, i.e., an integrated circuit; however, any electronic device may be employed within the scope of the claimed invention. The microprocessor includes an insulating silica base board 18. A microprocessor core 22 is mounted to the base board 18. As understood by those skilled in the art, the core 22 includes transistors and other components interconnected by a plurality of conductive members.

The electrical circuit 10 includes first and second electrically conductive members 26, 30 that cooperate to selectively provide electrical communication to and from the microprocessor core 22. The first member 26 in the embodiment depicted is an input/output pin through which electronic input and/or output signals are transmittable to the microprocessor core 22. As understood by those skilled in the art, microprocessor 14 includes a plurality of input and output pins through which the microprocessor core 22 sends and receives data in the form of electronic signals. Only one of the pins is shown in the Figures. The first member 26 thus functions as an electrical contact, which is engageable with a complementary contact on a printed circuit board, for example.

The first member 26 is mounted to the base board 18. The second member 30 is mounted with respect to, and in electrical communication with, the microprocessor core 22. The second member 30 is part of an electro-mechanical circuit protector 32, and at least partially defines an electrically conductive path from the pin, i.e., first member 26, to the core 22. The microprocessor 14 also includes a silica (or other IC substrate material known to those skilled in the art) outer case 34, which is mounted with respect to the base board 18 and which functions as a heat sink. The circuit protector 32 also includes an active material member 38 that is configured to undergo a change in at least one attribute in response to an activation signal.

The activation signal is produced when the amount of current flowing through the second member 30 exceeds a predetermined amount. The circuit protector 32 is configured such that the change in the attribute alters the resistance of the conductive path between the first member 26 and the second member 30, restricting or preventing current flow to the microprocessor core 22 and thereby protecting the microprocessor core 22 from excessive current and overheating.

Figure 2:
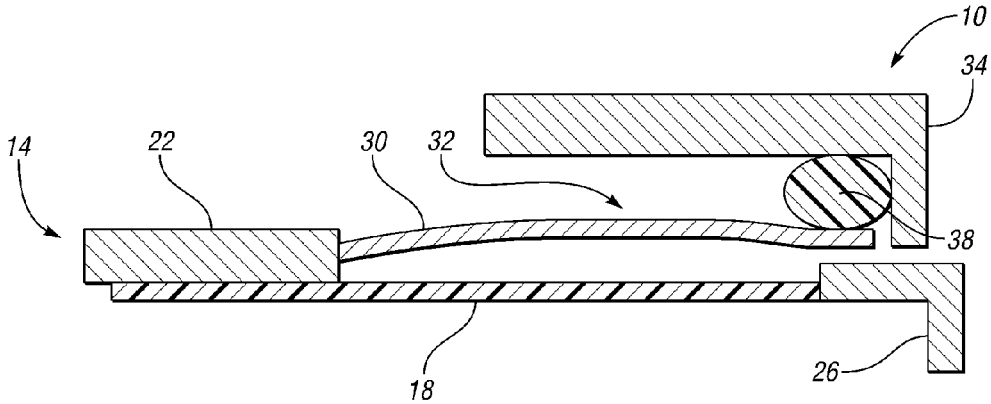
FIG. 2 is a schematic, sectional, side view of the electronic device and circuit protector of FIG. 1 with the conductor in a second position.

More specifically, in the embodiment depicted, the second member 30 is selectively movable between a first position, as shown in FIG. 1, and a second position, as shown in FIG. 2.

When the second member 30 is in the first position, the second member 30 is in contact with the first member 26, thereby establishing direct electrical communication from the first member 26 to the second member 30. Thus, when the second member 30 is in its first position, electrical current may flow from the first member 26 to the core 22 via the second member 30. Referring to FIG. 2, when the second member 30 is in its second position, the second member 30 does not contact the first member 26, and thus there is an air gap in the conductive path from the first member 26 to the core 22, which provides a large amount of resistance and prevents the flow of current from the first member 26 to the core 22.

The active material member 38 is mounted to the outer case 34 and to the second conductive member 30. In the embodiment depicted, the active material of member 38 is a shape memory alloy (SMA). A shape memory alloy is characterized by a cold state, i.e., when the temperature of the alloy is below its martensite finish temperature $M_f$. A shape memory alloy is also characterized by a hot state, i.e., when the temperature of the alloy is above its austenite finish temperature $A_f$. An object formed of the alloy may be characterized by a predetermined shape. When the object is pseudo-plastically deformed from its predetermined shape in the cold state, the strain may be reversed by heating the object above its austenite finish temperature $A_f$, i.e., applying a thermal activation signal sufficient to heat the object above its $A_f$ will cause the object to return to its predetermined shape. An SMA's modulus of elasticity and yield strength are also significantly lower in the cold state than in the hot state. As understood by those skilled in the art, pseudo-plastic strain is similar to plastic strain in that the strain persists despite removal of the stress that caused the strain. However, unlike plastic strain, pseudo-plastic strain is reversible when the object is heated to its hot state.

Member 38 is characterized by a predetermined shape, as shown in FIG. 2, and a pseudo-plastically deformed state, as shown in FIG. 1. More specifically, member 38 is configured such that it is characterized by pseudo-plastic tensile strain when the second member 30 is in its first position and in contact with the first member 26, as shown in FIG. 1, such that the height of member 38 is greater than its predetermined height. Heating the active material member 38 to its hot state (i.e., by applying a thermal activation signal to the active material member 38) reverses the pseudo-plastic tensile strain shown in FIG. 1, and the member 38 assumes its predetermined shape, as shown in FIG. 2. As the member 38 assumes its predetermined shape, the member 38 draws the second member 30 out of contact with the first member 26 and to its second position, thereby increasing resistance in the conductive path and preventing current flow to the microprocessor core 22.

The active material member 38 is in contact with the second member 30, and thus the active material member 38 is in direct conductive heat transfer relationship with the second member 30. The austenite finish temperature of the active material of member 38 is set to a temperature reached by the second member 30 when the amount of current flowing through the second member 30 exceeds a predetermined amount due to electrical resistance heating. The predetermined amount of current in the embodiment depicted is the maximum amount of current that the core 22 can safely receive without damage. Thus, the circuit protector 32 is configured such that, when the current flow in the second member 30 exceeds a predetermined amount, the active material member 38 assumes its predetermined shape which moves the second member 30 out of contact with the first member 26, thereby preventing current flow from the first member 26 to the core 22 and protecting the core 22 from overheating.

Alternatively, and within the scope of the claimed invention, the activation signal may be produced when the temperature of the core 22, member 30, member 26, etc. exceeds a predetermined amount, as a result of cooling system failure, environmental conditions, etc. More specifically, heat from the core 22, member 30, member 26, etc. is transferred to member 38. Member 38 may be heated to above its austenite finish temperature by the core 22, member 30, member 26, etc., and thereby stop the flow of electrical current.

In the embodiment depicted, the current protector 32 automatically resets when the temperature of the second member 30 (and thus the temperature of the active material member 38) cools. More specifically, the circuit protector 32 includes a spring that biases the second member 30 toward its first position. In the embodiment depicted, the second member 30 acts as the spring: the second member 30 is elastically deformed when moved from its first position to its second position, and is thus urged to return to its first position. In an alternative embodiment, and within the scope of the claimed invention, a separate spring may urge the second member toward its first position. For example, a coil spring may be disposed between the second member 30 and the outer case 34.

When the active material of member 38 is in its hot state, the modulus of member 38 is sufficiently high to resist the bias of the spring. However, as thermal energy is transferred from the second member 30 and the active material member 38 to the outer case 34, the modulus of the active material member 38 is reduced as the member 38 cools below the martensite finish temperature, and the force of the spring is sufficient to deform the member 38 and return the second member 30 to its first position, thereby re-establishing direct electrical communication from the first member 26 to the core 22 via the second member 30. The circuit protector may also be manually reset when the temperature conditions allow.

Figure 3:
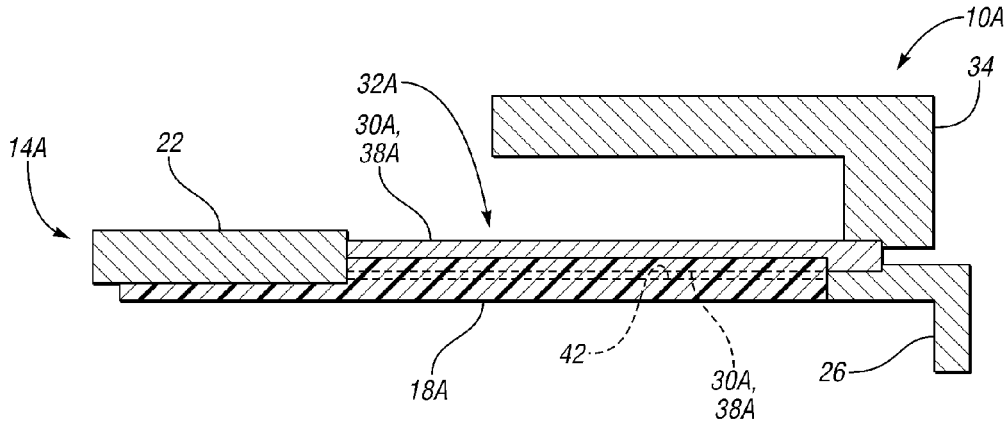
FIG. 3 is a schematic, sectional, side view of an alternative electronic device and a circuit protector in accordance with the claimed invention having a conductor in a first position.

Referring to FIG. 3, wherein like reference numbers refer to like components from FIGS. 1 and 2, a portion of an alternative circuit 10A is schematically depicted. The circuit 10A includes at least one electronic device 14A. In the embodiment depicted, the electronic device 14A is a microprocessor; however, any electronic device may be employed within the scope of the claimed invention. The microprocessor includes an insulating base board 18A. A microprocessor core 22 is mounted to the base board 18A.

The electrical circuit 10A includes first and second electrically conductive members 26, 30A that cooperate to selectively provide electrical communication to and from the microprocessor core 22. The first member 26 in the embodiment depicted is an input/output pin through which electronic input and/or output signals are transmittable to and from the microprocessor core 22.

The first member 26 is mounted to the base board 18A. The second member 30A is mounted with respect to, and in electrical communication with, the microprocessor core 22. The second member 30A is part of an electro-mechanical circuit protector 32A, and at least partially defines an electrically conductive path from the pin, i.e., first member 26, to the core 22. The microprocessor 14 also includes an outer case 34, which is mounted with respect to the base board 18 and which functions as a heat sink.

Base board 18A defines a groove 42 that extends from the core 22 to the pin 26. The second member 30A is at least partially disposed within the groove 42. The second member comprises an active material, i.e., shape memory alloy, and thus the second member 30A is also an active material member 38A. The second member 30A is shown in a first position in FIG. 3 and a second position in FIG. 4. When member 30A is in its first position, it is in contact with member 26, and thus provides direct electrical communication between member 26 and core 22. When member 30A is in its second position, it does not contact member 26; an air gap between member 26 and member 30A provides sufficient resistance in the conductive path to prevent the flow of current from pin 26 to core 22.

Figure 4:
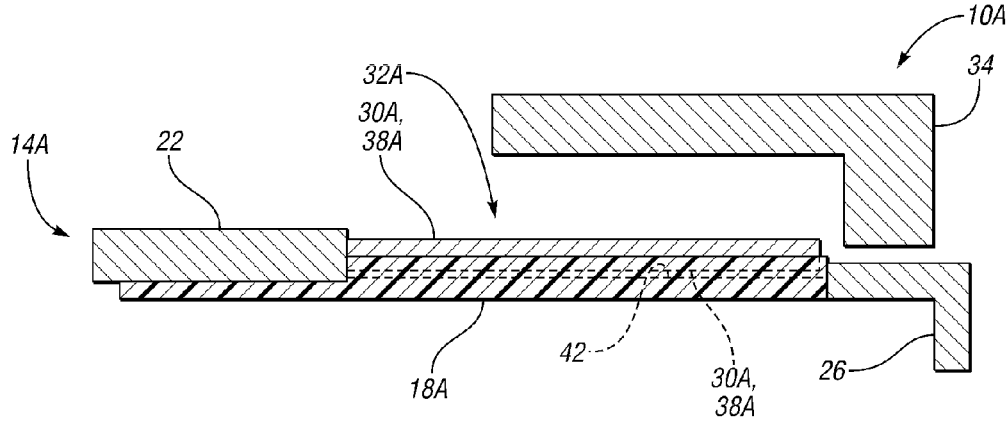
FIG. 4 is a schematic, sectional, side view of the electronic device and circuit protector of FIG. 3 with the conductor in a second position.

The second member 30A is characterized by a predetermined shape (length), which corresponds to its second position in FIG. 4. The second member 30A is characterized by tensile pseudo-plastic strain in its first position, as shown in FIG. 3. Accordingly, the length of member 30A is greater in the first position than in the second position. The second member 30A is configured to reach its austenite finish temperature when the amount of current flowing therethrough exceeds a predetermined amount due to electrical resistance heating. When the austenite finish temperature is reached, the tensile pseudo-plastic strain is reversed and the second member 30A moves to its second position, shown in FIG. 4, thereby stopping the flow of current.

The circuit protector 32A automatically resets when the SMA member 38A cools. In one embodiment, the second member 30A comprises a two-way shape memory alloy, where the phase change within the alloy provides both the contraction and lengthening action. Alternately for one-way SMA, as the member 30A cools, its diameter increases; thus, the walls of the groove 42 provide a return force that urges the member 30A to return to its first position and into contact with member 26. That is, the groove 42, or features along the groove 42, forces the SMA member 30A, 38A to lengthen and contract in a predictable way so as not to require the use of return springs. In addition to a two-way SMA, the circuit board itself or other spring elements could be attached to the member 30A and supply the return force.

It should be noted that, although shape memory alloys are employed herein, other active materials may be employed within the scope of the claimed invention, such as electroactive polymers, piezoelectric materials, and magnetostrictive and electrostrictive materials.

Those skilled in the art will recognize a variety of applications for the circuit protectors 32, 32A in the fields of avionic electronics, telecommunications, audio-visual equipment, automotive systems, aerospace, etc. For example, and within the scope of the claimed invention, the circuit protectors may be employed with back-up electronic driver systems, power transistors, circuit boards, wiring, cellular telephones, facsimiles, cable lines, video cassette recorders, televisions, radios, compact disc players, video cameras, video game machines, engine controllers, vehicle body controllers, automotive cooling systems, hydrogen fuel cell charging systems, battery systems for hybrid vehicles, heating and cooling controls, battery charging, motor protection, navigation systems, etc.

Circuit protectors 32, 32A may increase the possibility of recovering data from damaged computers, may provide a visual indicator of which circuit has failed, thereby reducing time to trouble shoot and repair the circuit, may be used in reverse as a temporary shut off, etc. It should be noted that a non-typical Hysteresis curve for circuit cooling time may result. It should also be noted that the active material members may require a non-standard transformation temperature. It may be desirable to employ backup circuitry for certain systems.

While the best modes for carrying out the invention have been described in detail, those familiar with the art to which this invention relates will recognize various alternative designs and embodiments for practicing the invention within the scope of the appended claims.

The invention claimed is:

1. An apparatus comprising:

an electronic device;

an electrical contact;

a circuit protector that at least partially defines a conductive path from the contact to the electronic device;

wherein the conductive path includes a first conductive member and a second conductive member;

wherein the circuit protector includes an active material that is one of shape memory alloy and shape memory polymer, that contacts the second conductive member, and that is configured to undergo a change in at least one attribute in response to an activation signal;

wherein the second conductive member is selectively movable between a first position in which the second conductive member is in contact with the first conductive member, and a second position in which the second conductive member does not contact the first conductive member; and wherein the circuit protector is configured such that the change in at least one attribute causes the second conductive member to move between the first and second positions.

2. The apparatus of claim 1, wherein the first conductive member is the contact.

3. The apparatus of claim 1, wherein said change in at least one attribute includes a change in shape of the active material.

4. The apparatus of claim 3, wherein the second conductive member comprises the active material such that the active material defines a portion of the conductive path from the contact to the electronic device.

5. The apparatus of claim 4, further comprising a third member that defines a groove; and wherein the second conductive member is at least partially disposed within the groove.

6. The apparatus of claim 1, wherein the electronic device is an integrated circuit and wherein the electrical contact is a pin.

7. The apparatus of claim 1, wherein the activation signal is thermal.

8. An apparatus comprising:

a microprocessor having an insulating base board and a core mounted with respect to the base board;

an electrical contact;

a circuit protector that at least partially defines a conductive path from the contact to the core;

wherein the conductive path includes a first conductive member and a second conductive member;

wherein the circuit protector includes an active material that is one of shape memory alloy and shape memory polymer, that contacts the second conductive member, and that is configured to undergo a change in at least one attribute in response to an activation signal;

wherein the second conductive member is selectively movable between a first position in which the second conductive member is in contact with the first conductive member, and a second position in which the second conductive member does not contact the first conductive member; and wherein the circuit protector is configured such that the change in at least one attribute causes the second conductive member to move between the first and second positions.

* * * * *